US005496394A

United States Patent [19]

Nied

[11] Patent Number: 5,496,394

[45] Date of Patent: Mar. 5, 1996

[54] CYCLONE SEPARATOR

[76] Inventor: Roland Nied, Raiffeisenstrasse 10, D-8901 Bonstetten, Germany

[21] Appl. No.: 240,716

[22] PCT Filed: Nov. 15, 1992

[86] PCT No.: PCT/EP92/02628

§ 371 Date: May 11, 1994

§ 102(e) Date: May 11, 1994

[87] PCT Pub. No.: WO93/09883

PCT Pub. Date: May 27, 1993

[30] Foreign Application Priority Data

Nov. 15, 1991 [DE] Germany ..... 41 37 633.1

[51] Int. Cl.[6] ..... B07B 7/00

[52] U.S. Cl. ..... 95/271; 55/394; 55/408; 55/438; 55/457

[58] Field of Search ..... 55/391, 394, 399, 55/408, 438, 454, 456, 457, 460; 95/270, 271

[56] References Cited

U.S. PATENT DOCUMENTS

| | | | |
|---|---|---|---|
| 2,087,789 | 7/1937 | Allardice | 55/454 |
| 2,182,862 | 12/1939 | Allardice | 95/271 |
| 2,738,855 | 3/1956 | Fallon et al. | 55/438 |
| 2,989,146 | 6/1961 | Lundy | 55/408 |
| 3,406,504 | 10/1968 | Sylvan | 55/438 |
| 4,969,934 | 11/1990 | Kusik et al. | 95/271 |

FOREIGN PATENT DOCUMENTS

| | | |
|---|---|---|
| 2426295 | 12/1975 | Germany . |
| 3814458 | 11/1989 | Germany . |

*Primary Examiner*—C. Scott Bushey
*Attorney, Agent, or Firm*—Levine & Mandelbaum

[57] ABSTRACT

A cyclone separator has with a separation chamber in a spiral housing fitted with an inlet for the material to be separated in parallel to a tangent to the separator housing, a separate tangential inlet for a separator gas, and a longitudinal outlet arranged concentrically about the separator axis to allow the gas and fine particulate matter to pass out of the separation chamber. The separator further has a ring of vanes located in the spiral housing between the separation chamber, which is arranged coaxially to the outlet, and an outer annular space, the material inlet feeding into the separation chamber and the gas inlet feeding into the outer annular space.

6 Claims, 2 Drawing Sheets

CYCLONE SEPARATOR

BACKGROUND OF THE INVENTION

The present invention pertains to a cyclone separator, which has as the principal components a spiral housing with inlets for raw material and separator gas, a separator wheel, a ring of vanes, and outlets for coarse and fine particulate matter as well as the separator air. The present invention is a novel design of such a cyclone separator, in which it is possible to carry out an operating method which fundamentally differs from the prior art operating methods and provides particularly good separation results without extra expense for additional structures.

However, it seems best for the understanding of the present invention to use German Offenlegungsschrift No. DE-OS 24,26,295 as the starting point, because the design of a cyclone separator according to the present invention seems to differ only slightly from a cyclone separator according to this prior-art reference, but the completely different mode of operation of a cyclone separator according to the present invention can be explained particularly well in comparison with this prior art.

DE 24,26,295, which is the closest prior art, is based on a cyclone separator, in which the material to be separated is introduced tangentially to the inner circle of a stationary vane ring with adjustable vanes, to the outer circle of which the separator air is tangentially introduced. The front walls of the separation space surrounded and delimited by the vane ring are rotatable just as the material to be separated in order to reduce frictional losses. The vanes of the vane ring are dimensioned and adjustable such that the material to be separated is separated into coarse matter and fine particulate matter in the separation space. The coarse matter is fed, near the inner circle of the vane ring, to a strip-off edge and is separated from the area of the fine particulate matter by means of the strip-off edge, to be fed to the coarse matter outlet. The remaining mixture of separator air and fine particulate matter is fed to the fine particulate matter outlet in a flow forming a sink. The present invention is based on the consideration that there is a risk in such cyclone separators that so-called spray particles will enter the fine particulate matter, already separated from the coarse matter, from the coarse matter located in front of the strip-off edge, so that the fine particulate matter will still contain a possibly small, but unintended percentage of coarse matter in the form of the above-mentioned spray particles. To eliminate this disadvantage, a coarsely separating separator wheel, which again separates the coarse matter component from the fine particulate matter by applying the centrifugal action, is arranged in the fine particulate matter outlet. Consequently, a high design expense is required in the form of the separator wheel merely to separate the small percentage of spray particles from the fine particulate matter. In addition, it is difficult to adjust the vanes of the stationary vane ring such that both the crude gas flow interspersed with the material to be separated in a well-dispersed form is introduced and good separation of the coarse matter from the fine particulate matter takes place. Only a compromise between these two requirements is possible, as a rule.

SUMMARY OF THE INVENTION

The present invention takes a different approach insofar as the separation of the fine particulate matter from the coarse matter does not take place in a separation space, in the outlet of which a separator wheel is arranged specifically for final purification of the fine particulate matter already separated from the coarse matter. Instead, a separator wheel is provided for the actual separation of the coarse matter component from the fine particulate matter component. The stationary vane ring in a separator used for the present invention is correspondingly designed such that the separator air, which is dispersed with the fine particulate matter and the coarse matter in a well dispersed form, is introduced in the most uniform distribution possible to the circumference of and into the separator wheel. The separation into coarse matter and fine particulate matter takes place in the separator wheel, which is directly preceded by the vane ring. The vane ring has the exclusive task of optimally dispersing the raw material in the separator air and of feeding the flow of raw material thus processed to the separator wheel in a uniformly dispersed form, rather than in a vane-surrounded, stationary separation space, as in the above-described prior art, which is followed by a final-purification separator wheel (removal of spray particles, whose mass is several times the mass of the particles of the fine particulate matter, from the flow of fine particulate matter).

Separator wheels designed for this task have been known per se (e.g., EP 89121065.0). However, arranging a vane ring upstream of such separator wheels in the above-described manner has been unknown.

There is an essential difference between the closest prior art and the present invention with respect to the "strip-off edge" as well, because the coarse matter is stripped off with the strip-off edge in the prior art, whereas a guide edge according to the present invention deflects only coarse particles, which do not enter, as intended, the separator wheel, despite the vane ring of corresponding design, and consequently may possibly correspond, in terms of their amount, to the spray particle component according to the prior art.

BRIEF DESCRIPTION OF THE DRAWINGS

The present invention will be explained with reference to the drawings.

DESCRIPTION OF THE PREFERRED EMBODIMENT

Figure 1:
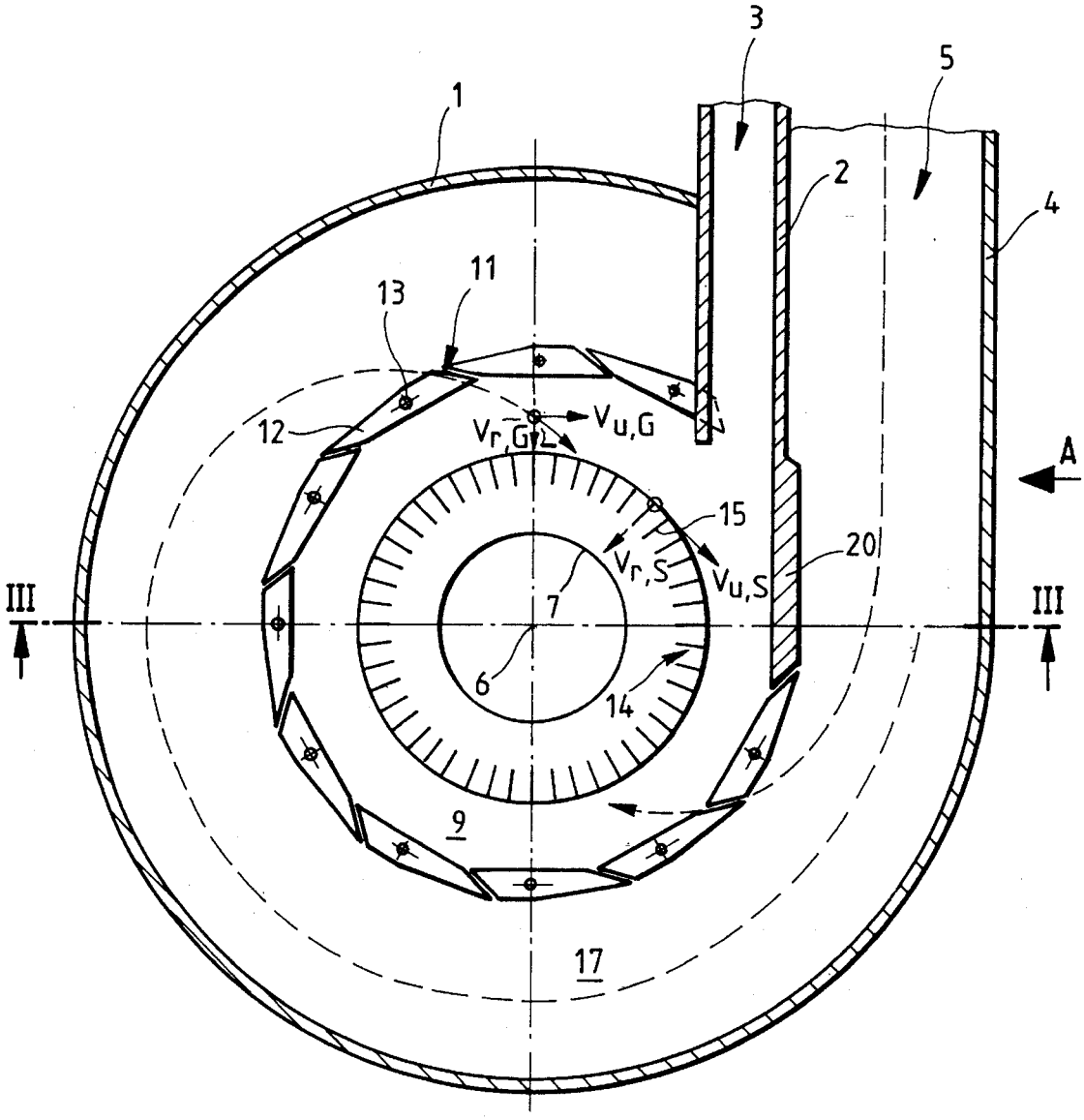
FIG. 1 shows a vertical central longitudinal section through a cyclone separator designed and operating according to the present invention.

A separation chamber 9 is surrounded by a stationary vane ring 11. Vanes 12 of the vane ring 11 are individually adjustable around their respective longitudinal axes 13. The vane ring 11 forms part of a circle located concentrically to the separator axis 6.

A prior-art, rotating separator wheel 14, which has vanes 15, is arranged in the separation chamber 9 surrounded by the vane ring 11, likewise concentrically to the separator axis 6. The annular space between the outer circle of the separator wheel 14 and the inner circle of the vane ring 11 is substantially narrower than in the prior art, because no actual separation is to take place in it, contrary to the prior the art.

The width of the annular space between the separator wheel and the vane ring is selected only to be such as is necessary for the ordered passage of the raw material from the vane ring into the separator wheel.

The inlet 3 for the material to be separated opens tangentially into the separation chamber 9 in the area of the annular space between the vane ring 11 and the separator wheel 14. The separator air inlet 5 opens tangentially into the annular space 17 between the vane ring 11 and the said spiral housing 1. The inlet 3 for the material to be separated and the said separator air inlet 5 are pipes arranged in parallel to one another. A spray particle outlet 8 having a guide plate 18, which is positioned obliquely by at least 45°, is attached to a wall section 19 of the separator housing, and separates the inner separation chamber 9 from the outer annular space 17 together with a wall section 20 attached to the pipe 2 of the inlet 3 for the material to be separated. The guide plate 18 is located, with one of its edges, at the circumference of the vane ring 11 toward the end of the flow path in the separator housing, i.e., toward the inlet 3 for the material to be separated, and with its other end close to the separator wheel 14 to the extent permissible for unhindered rotary movement of the separator wheel 14.

The separator air flows through the flow channels between the vanes 12 of the said vane ring 11 from the outside to the inside. The vanes 12 are mounted rotatably in the housing 1 such that both the angle at which the separator gas flows in and the gap width of the flow between the vanes 12 can be varied. The material to be separated is charged in on the inside of the said vanes 12 of the vane ring 11, and the separator gas flows intensely through it at the gaps between the vanes 12. Vortex formation, which prevents material to be separated from settling on the vanes, becomes established in the flow channels between the vanes of the vane ring 11 because of the prevailing flow conditions brought about by the setting and the shape of the vanes. A spiral flow becomes established in the separation chamber 9, and some separation, although slight and undesired, takes place in the spiral flow. Particles that rotate in the separation chamber 9 at the velocity $v_{u,G}$ are forced to the outside by a centrifugal force $F_T$. At the same time, the sweeping force $F_W$, which is caused by the radial velocity of the gas, $V_{r,G}$, mainly causes particles to be swept toward the inside of the separation chamber 9.

The same physical relationships prevail in the separator wheel 14 with the vanes 15, which is arranged concentrically in the separation space 9; however, the radial and circumferential velocities are influenced here by the gas mass flow and the speed of the separator wheel 14, rather than by the gas mass flow and the vane setting. In order for the separator wheel 14 to determine the fineness, the separation limit, i.e., the gaps between the vanes 12, leading to the annular space 9 is set to be coarser in the annular space than on the separator wheel 14.

Thus, the outer vane ring 11 is used for a relatively slight preseparation and, especially, for the intense dispersion and disintegration of the material to be separated, which can be considered to be an essential advantage, and which can be achieved with the present invention. The actual separation takes place at high efficiency in the separator wheel, and the particles deflected by the deflecting device 8 represent, in a manner of speaking, a spray material consisting of particles of extremely high mass and particles which are subject to special influences; in fact, the overwhelming majority of the particles are caused to enter the separator wheel, which is used for the actual separation.

The fine particulate matter finally leaves the separator via the product or fine particulate matter outlet 7 of the separator wheel 14; spray material, which circulates close to the vane ring 11, is preferably stripped off via the guide plate 18 of the spray particle outlet 8, which is set obliquely by at least 45°, and can thus be removed from the separation space.

The vanes 12 of the said outer, static vane ring 11 are set such that the flow angle of the vanes 12 and the cross sections of the vane channels between the vanes lead, according to the present invention, to a spiral cyclone separation, which yields a coarser separation size than would correspond to the conditions prevailing at the outer edge of the vane-type separator wheel in the annular separation space 9 between the vane ring 11 and the vane-type separator wheel 14.

Figure 2:
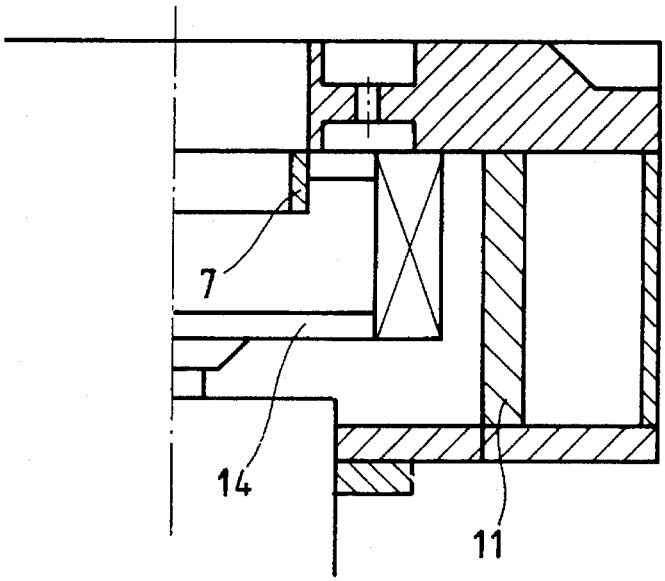
FIG. 2 shows a horizontal central longitudinal section through the cyclone separator according to FIG. 1, corresponding to line A—A in FIG. 1.

The sectional view according to FIG. 2 shows parts of the separator according to FIG. 1 with the reference numerals used in FIG. 1, without the spray particle edge 18 and the spray particle outlet 8.

Figure 3:
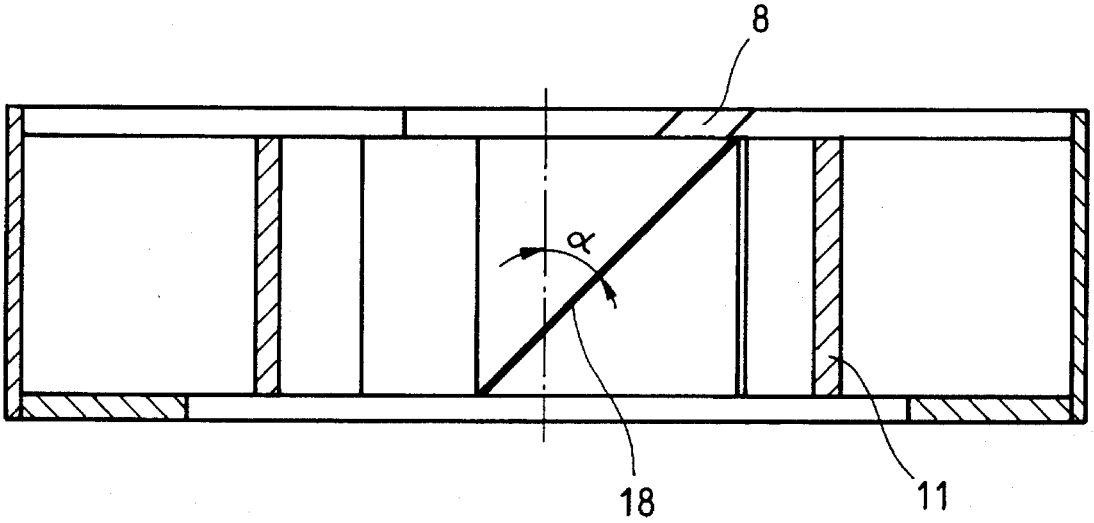
FIG. 3 shows a section corresponding to FIG. 2, in which the separator wheel has, however, been omitted to show the guide edge, which is located behind the separator wheel in the sectional view in FIG. 2.

The section according to FIG. 3 correspondingly shows the parts of FIG. 1 with the reference numerals of FIG. 1, without showing the separator wheel 14, but the setting angle α of the spray particle edge 18, which shall be at least 45° according to the present invention, is recognizable.

To meet the criterion of small width of the annular space between the vane ring 11 and the separator wheel 14, the ratio of the diameter of the vane ring 11 to the diameter of the separator wheel (ratio of the central circle of the vane ring to the central circle of the separator wheel) shall be preferably 1:0.8 and, at most, 1:0.65. The setting angle of the vanes 12 of the vane ring to a tangent to the circumference of the vane ring shall be preferably 25°.

The separator is arranged vertically according to FIG. 1 (with horizontal separator axis 6), but a horizontal arrangement with vertical separator axis 6 is possible.

The spray particle outlet 18 has the guide plate 8 and an opening in the wall (which is the rear wall relative to the representation in FIG. 1) of the separator housing, to which the guide plate 8 leads.

Since no separation is to take place in the annular space 17, this annular space may have constant width, even though it may also become narrower in the direction of flow.

I claim:

1. Cyclone separator with a stationary spiral housing, a vane ring stationarily arranged in the spiral housing, said vane ring having adjustable vanes, a separator wheel arranged coaxially within the vane ring, means for tangentially introducing crude gas and separator gas into said housing, and guide edge means for deflecting coarse particles in an end zone of a spiral flow in an annular space between the vane ring and the separator wheel, comprising (a) a first tangential inlet pipe for the introduction of material to be separated into the annular space between the vane ring and the separator wheel;

(b) a second tangential inlet pipe for the introduction of separator gas, arranged in parallel to the first inlet pipe for the introduction of the material to be separated;

(c) means for mixing the separator gas introduced through the second inlet pipe with the material to be separated, introduced through the first inlet pipe;

(d) outlet means in the form of a guide plate at an end of a flow path for the material to be separated, said guide plate being placed obliquely to the flow in the annular space between the vane ring and the separator wheel, inclined in relation to an axis of the separator and having one of its edges on the circumference of the vane ring, being attached to a wall section of the separator housing, and having another edge proximate to the separator wheel, and (e) an outlet means for fine particulate matter, arranged concentrically in said annular space.

2. Cyclone separator in accordance with claim 1, wherein the angle of the guide plate to the separator axis is at least 45°.

3. Cyclone separator in accordance with one of the claims 1 and 2, wherein the ratio of the diameter of the vane ring to that of the separator wheel is at most 1:0.65.

4. Cyclone separator in accordance with one of the claims 1 and 2, wherein the ratio of the diameter of the vane ring to that of the separator wheel is 1:08.

5. Cyclone separator in accordance with claim 1 wherein the angle of the vanes of the vane ring to a tangent to the circumference of the vane ring is 25°.

6. Process for separating course material and fine material in a gas comprising injecting said gas with said material into a cyclone separator having a stationary spiral housing, a vane ring stationarily arranged in the spiral housing, said vane ring having adjustable vanes, a separator wheel arranged coaxially within the vane ring, means for tangentially introducing said gas with said material and a separator gas into said housing, and guide edge means for deflecting coarse particles in an end zone of a spiral flow in an annular space between the vane ring and the separator wheel, said separator comprising (a) a first tangential inlet pipe for the introduction of material to be separated into the annular space between the vane ring and the separator wheel;

(b) a second tangential inlet pipe for the introduction of separator gas, arranged in parallel to the first inlet pipe for the introduction of the material to be separated;

(c) means for mixing the separator gas introduced through the second inlet pipe With the material to be separated, introduced through the first inlet pipe;

(d) material outlet means in the form of a guide plate at the end of a flow path for the material to be separated, said guide plate being placed obliquely to the flow in the annular space between the vane ring and the separator wheel, inclined in relation to an axis of the separator and having one of its edges on the circumference of the vane ring, being attached to a wall section of the separator housing, and having another edge proximate to the separator wheel, and (e) outlet means for fine particulate matter, arranged concentrically in said annular space.

* * * * *